US005842418A

United States Patent [19]

Corrado et al.

[11] Patent Number: 5,842,418

[45] Date of Patent: Dec. 1, 1998

[54] APPARATUS AND METHOD FOR CLEANING A ROLLER

[75] Inventors: Frank C. Corrado; James W. Fischer, both of Rochester; Gary R. Larsen, Webster; Ronald W. Sweet, New York, all of N.Y.

[73] Assignee: SeraTek LLC, Livonia Center, N.Y.

[21] Appl. No.: 936,713

[22] Filed: Sep. 24, 1997

Related U.S. Application Data

[63] Continuation-in-part of Ser. No. 667,177, Jun. 20, 1996, Pat. No. 5,699,738, which is a continuation-in-part of Ser. No. 439,063, May 8, 1995, Pat. No. 5,611,281.

[51] Int. Cl.[6] ..... B41F 35/00

[52] U.S. Cl. ..... 101/425; 101/424

[58] Field of Search ..... 101/425, 424, 101/423; 15/256.5, 256.51

[56] References Cited

U.S. PATENT DOCUMENTS

| | | | |
|---|---|---|---|
| 3,084,626 | 4/1963 | Stobb | 101/425 |
| 5,509,353 | 4/1996 | Aoki | 101/425 |
| 5,519,914 | 5/1996 | Egan | 101/425 |
| 5,537,924 | 7/1996 | Krause | 101/423 |

*Primary Examiner*—Edgar S. Burr
*Assistant Examiner*—Anthony H. Nguyen
*Attorney, Agent, or Firm*—M. Lukacher; K. Lukacher; R. E. Brown

[57] ABSTRACT

A roller cleaning system includes a pad disposable against a roller for cleaning the surface of the roller when the roller is rotated. The pad is supported in a frame which may be stationary or mounted for translation so that the pad may traverse a length of the roller while cleaning the roller surface. The pad may be further provided with an actuator for urging a portion of the pad against the roller at an additional force. The frame has a first portion disposed at a fixed distance from the surface of the roller and a second portion carrying the cleaning pad, the second portion being pivotable from the first portion about an axis parallel to the axis of the roller. Means are included for measuring torque exerted on the pivot, which torque is indicative of frictional drag on the cleaning pad. In a preferred embodiment, a piezo-electric strain gauge disposed between the frame portions is connected in a feedback loop with a controller and the pad actuator. As the roller turns against the pad, the resulting drag exerts a torque about the frame pivot, which produces an output signal to the controller. Under steady-state conditions, the output signal is constant and the controller takes no action. If the frictional drag begins to increase, the torque also begins to increase, and the controller then reduces the force exerted by the actuator against the pad to reduce the frictional drag.

17 Claims, 2 Drawing Sheets

APPARATUS AND METHOD FOR CLEANING A ROLLER

Figure 1:
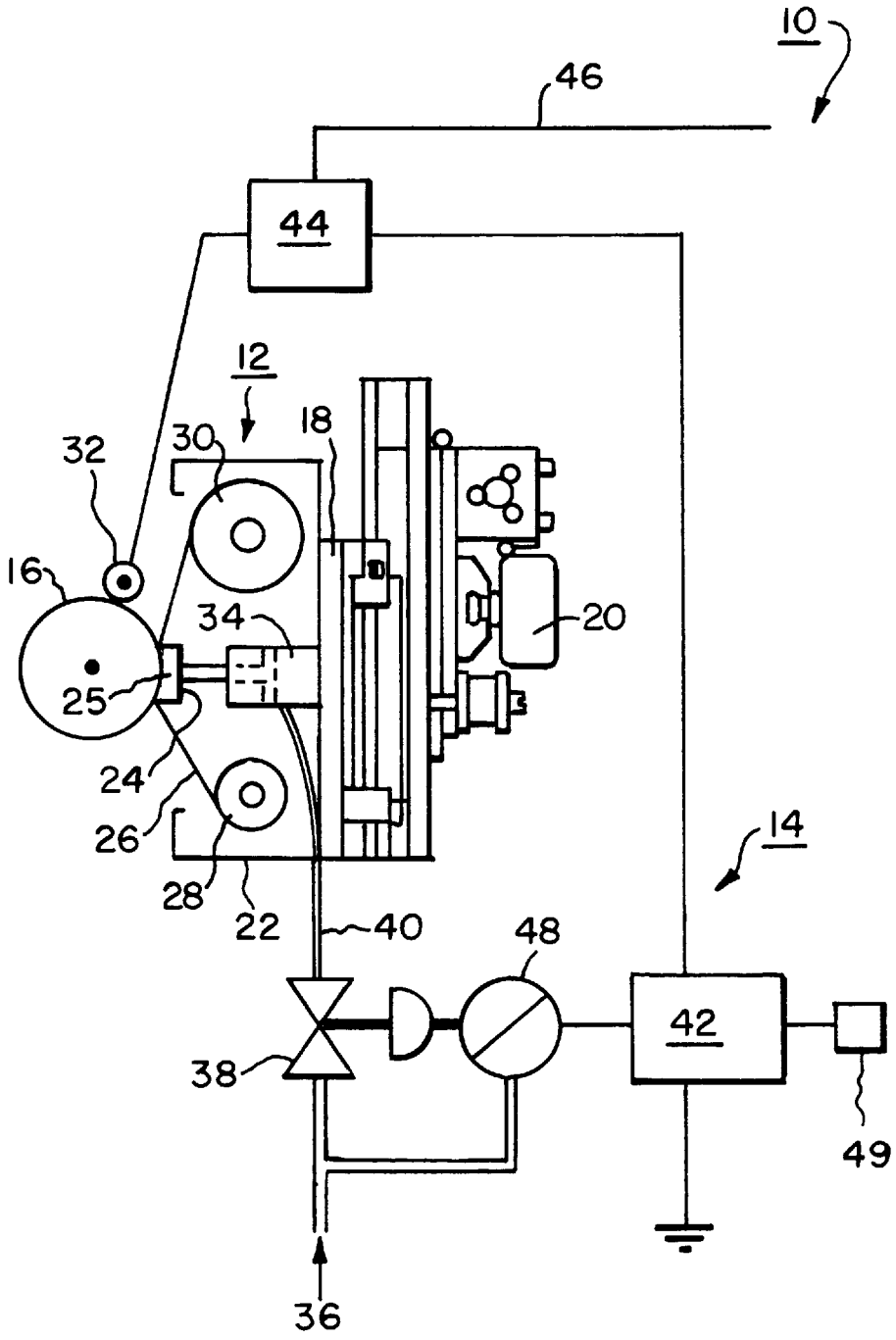

This application is a continuation-in-part of our allowed application, Ser. No. 08/667,177 filed Jun. 20, 1996, now U.S. Pat. No. 5,699,738, which is a continuation-in-part of our application, Ser. No. 08/439,063 filed May 8, 1995, now matured as U.S. Pat. No. 5,611,281 (281) issued Mar. 18, 1997. The U.S. Pat. No. 5,699,738, is hereby incorporated by reference.

The present invention relates to systems (apparatus and methods) for removing contaminants from process rollers and more particularly to apparatus and methods for washing and scrubbing contaminants from process rollers. This invention provides apparatus and methods for removing accumulated particles from contact cleaning rollers used to clean such particles from substrates, which substrates may be other process rollers or sheet or web stock being conveyed as by process rollers.

A common problem with process rollers is that they eventually accumulate contaminants on their surfaces, especially foreign particles which can cause unwanted physical and/or chemical anomalies in the substrates being conveyed by such rollers and in coatings upon the substrates. All such process rollers, therefore, require cleaning of their surfaces from time to time. The term "process roller" may include not only conventional metal or polymer rollers used to convey web or sheet stock along a path but also specialty rollers such as, for example, contact cleaning rollers (also referred to herein as "CCR's") used either to clean the web or sheet substrate directly or to clean other conveyance rollers along the web path.

The problem of retained contaminants is particularly acute for CCR's which are intended by their very nature to become clogged on their surfaces as they remove particles from the surfaces of substrates over which they have been rolled and which must be renewed by cleaning in order to restore their particle-removing effectiveness.

In the process roller cleaning apparatus of the allowed parent application, a cleaning pad is brought into rubbing contact with the contaminated surface of a roller to be cleaned. The roller is rotationally driven past the pad, which may be dry or, typically, moistened with a suitable liquid to aid in dislodging or dissolving the contaminants on the roller surface. Such rubbing or scrubbing of the cleaning pad against the roller causes contaminants to be transferred from the roller to the cleaning pad. The pad may consist of a simple resilient material such as a sponge, or, more typically, a cleaning web of cloth in contact with the roller surface, supported by a backing element such as a sponge to urge the cleaning web against the roller at a first force. The cleaning web may be intermittently or continuously dispensed from an unsoiled source to present clean web to the roller, the soiled web being accumulated out of contact with the roller. The pad including the web may be moved axially of the roller during cleaning so that a pad substantially narrower than the roller can progressively clean the entire roller surface, as disclosed in our above referenced '281 patent.

Further disclosed in the allowed parent application, an actuator is disposed for actuation in the direction of the roller against a portion of the rear surface of the cleaning pad, preferably a central portion, at a second force which is in addition to the first force being applied over the entire pad. This localized higher force is extremely effective in accelerating the rate of cleaning of the roller by the pad. In wet cleaning installations, the cleaning fluid acts not only as a cleaning agent but also as a lubricant to reduce the frictional drag of the pad against the roller.

Typically, the cleaning fluid is supplied continuously to the pad during cleaning. If the supply fails, dangerously high frictional forces can build up rapidly, which can result in permanent damage to the roller surface. Contact cleaning rollers, having typically a relatively soft surface, are especially vulnerable to damage from such forces.

In the allowed parent application, a control system is disclosed wherein the frictional drag during cleaning is sensed as a component of the load on the motor driving the roller. If the cleaning area becomes dry, frictional resistance begins to increase. As the motor load also begins to increase, the controller automatically begins to reduce the second force on the cleaning pad to reduce frictional resistance of the pad against the roller. If the motor load continues to increase, the controller will continue to decrease the second force. Preferably an alarm limit is established within or at the limit of controller action, at which point the system presents an alarm condition and activates an alarm. Preferably, cleaning of the roller is automatically terminated at the alarm, either by separating the roller from the cleaning pad or by shutting down the roller drive, or by both.

In an alternative embodiment, the drive motor may be such that increased frictional load causes a decrease in motor speed, for example, an air motor or an hydraulic motor. In such case, the control scheme can utilize the rotational speed of the motor as the set point for the controller. The action of the controller and the alarm is the same as above.

The disclosed system functions well for cleaning relatively small, light-weight rollers which typically are driven by fractional-horsepower motors, wherein a small change in load is easily sensed. However, many industrial processes utilize very large and heavy rollers which may be driven by large, multiple-horsepower motors wherein small but significant load changes may not be easily recognizable. Thus, another approach is needed for sensing the onset of an unacceptably high friction condition.

It is a principal object of the invention to provide an improved method and apparatus for the feedback control of frictional drag between a cleaning pad and a rotating roller being cleaned by the pad.

It is a further object of the invention to provide an improved method and apparatus for sensing changes in frictional drag between a cleaning pad and a roller being cleaning by the pad.

It is a still further object of the invention to provide an improved method and apparatus for controlling the frictional drag between a cleaning pad and a roller being cleaned by the pad which is useful for rollers of any length, diameter, and weight.

It is a still further object of the invention to provide improved apparatus for controlling the frictional drag between a cleaning pad and a roller being cleaned by the pad, which apparatus is relatively inexpensive to install and maintain.

Briefly described, in a roller cleaning system embodying the invention, a pad is disposed against a roller at a first force as by a device which provides static or dynamic pressure, referred to as a first actuator, for cleaning the roller when the roller is rotated. The pad is supported in a frame which may be stationary or mounted for translation, for example, on rails, parallel to the axis of the roller so that the pad may traverse a programmed axial length of the roller while cleaning the roller surface. The pad is further provided with a separate actuator for urging a portion of the pad against the roller at a second and additional force. Frictional control is provided in that the frame has a first portion disposable at a programmable first distance from the surface of the roller, and a second portion carrying the cleaning pad, the second portion being pivotable from the first portion about an axis parallel to the axis of the roller. Means are included for measuring torque exerted on the pivot, which torque is the net resultant of gravitational force on the second frame portion and frictional drag on the cleaning pad.

In a preferred embodiment, the range of pivoting is limited by first and second mating stops on the first and second frame portions, respectively. Disposed between the stops is means for measuring the force exerted on the stops, for example, a piezo-electric strain gauge, connected in a feedback loop with a controller and the pad actuator. As the roller turns against the pad, the resulting drag exerts a torque about the frame pivot and generates a force on the measuring means, which produces an output signal to the controller. Under steady-state conditions, the output signal is constant and the controller takes no action. If the frictional drag begins to increase, the force exerted against the measuring means also increases, and the controller then reduces the force exerted by the actuator against the pad as in the parent art.

The controller of the subject invention may also be programmable to respond to a variable set point, so that the first and/or second forces may be varied with time to permit differing portions of the roller to be cleaned at differing amounts of force on the cleaning pad. For example, the outer portions of the roller surface near the ends may benefit from increased first and/or second cleaning forces. Additionally, vigorous cleaning of the roller surface may not be needed on every axial cycle of the traversing cleaning system along the length of the roller, and pad life may be extended by programming the controller to exert a higher first and/or second force on, for example, every fifth or tenth such cycle.

The subject invention is also useful in simple cleaning installations not equipped with an actuator for providing an additional, localized force to the pad. The apparatus and control loop may include instead other means for reducing the frictional drag such as, for example, slowing the rotational speed of the roller or increasing the spacing between the roller and the cleaning apparatus.

Figure 2:
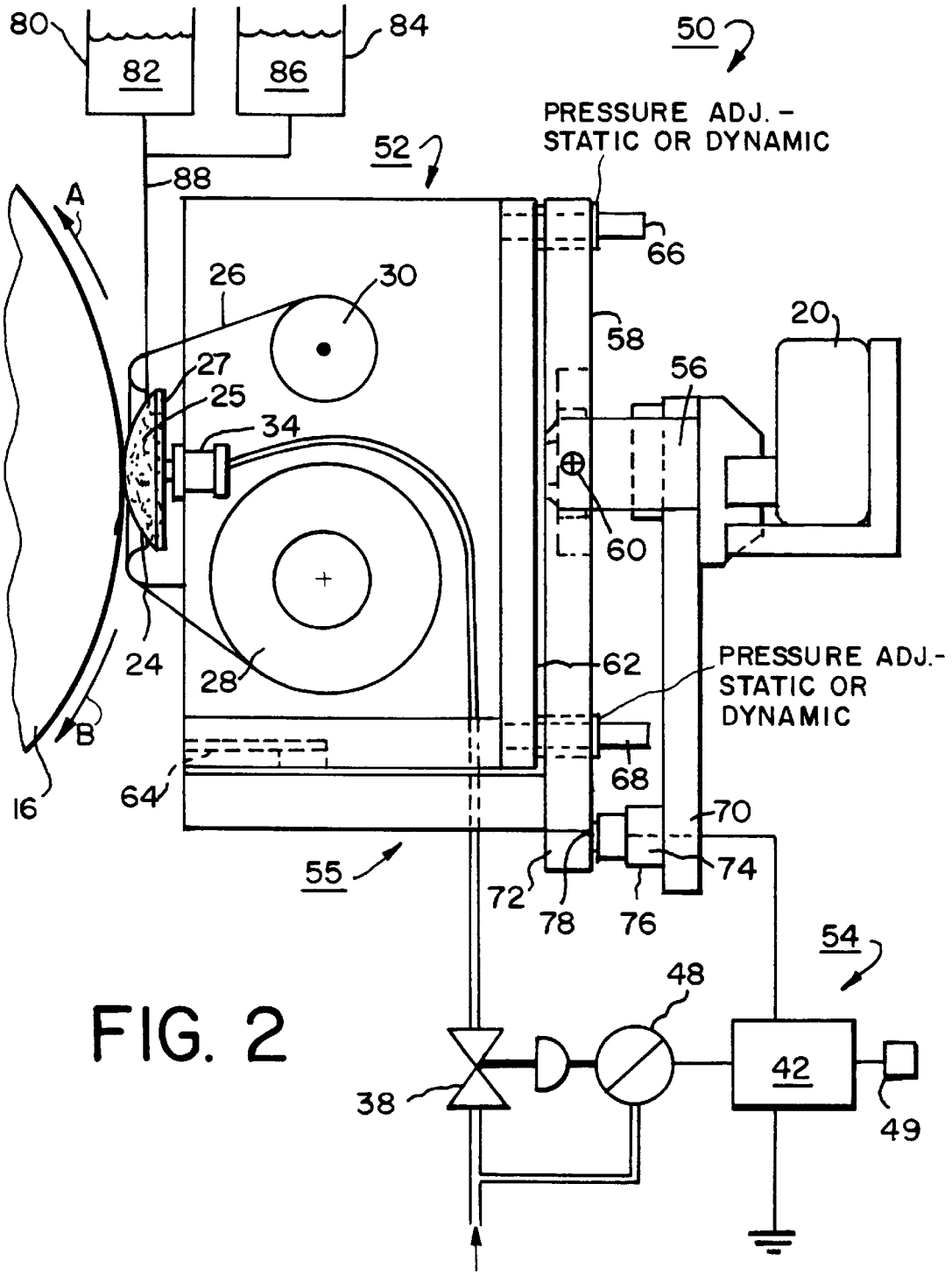

The foregoing and other objects, features, and advantages of the invention, as well as presently preferred embodiments thereof, will become more apparent from a reading of the following description in connection with the accompanying drawings in which:

FIG. 1 is an elevational view in cross-section of a roller cleaning system, according to applicants' copending allowed application, with a schematic drawing of an existing control loop for controlling frictional drag exerted by a cleaning pad against a roller by sensing the load imposed on the motor drive and varying the pressure exerted on the cleaning pad by an actuator to maintain a constant motor load; and FIG. 2 is an elevational view in cross-section of a roller cleaning system in accordance with the invention, showing a schematic drawing of a control loop for controlling frictional drag exerted by a cleaning pad against a roller by sensing the torque imposed on the cleaning apparatus about a horizontal axis thereof and varying the pressure exerted on the cleaning pad by an actuator to maintain a constant torque.

Referring to FIG. 1, there is shown a roller cleaning system 10 in accordance with the prior art, comprising a roller cleaning assembly 12 and controller in a control loop 14. System 10 is in position to clean a process roller 16, which may be a conventional conveyance roller or a specialty roller such as, for example, a contact cleaning roller, a coating roller, a fountain roller, a gravure roller, or the like.

In assembly 12, a frame 18 is mounted at a fixed distance from roller 16 for translation axially of roller 16 along rail guide 20. Frame 18 supports roller cleaning apparatus 22 including a cleaning pad 24 comprising a backing element 25 and a cleaning web 26. Other cleaning pad configurations may also be used, for example, a resilient material active directly upon the surface of roller 16 without resort to an additional web 26. In the preferred embodiment, backing element 25 may be any suitable resilient material, preferably a sponge or sponge cartridge, and operates to urge cleaning web 26 against roller 16 at a substantially uniform pressure over the entire surface of element 25. Preferably, cleaning web 26 is continuously wetted at the contact point with roller 16 by a cleaning fluid dispensed from a reservoir (not shown) included in assembly 12. Cleaning web 26 is dispensed intermittently or continuously from a feed roll 28 of material and is accumulated on a take-up roller 30 when soiled.

Roller 16 is driven in rubbing contact past cleaning pad 24 by a friction drive wheel 32. Preferably, roller 12 is driven at a fixed rotational speed experimentally predetermined to yield adequate cleaning of roller 16 in a desired length of time. Assembly 12 may be moved axially of roller 16 during cleaning so that a relatively narrow cleaning web can clean a relatively long roller.

An actuator 34 is disposed between the back side of backing element 25 and frame 18 and is preferably a pneumatic cylinder supplied with pressurized air from a high-pressure source 36 through a reducing valve 38 and a supply line 40. Actuator 34 engages only a portion of the back side of element 25, thereby creating a second localized force against pad 24 which is additive over that portion of the element to the first force applied over the entire pad.

The controller in the control loop 14 is an electronic controller 42 which senses a signal from a conventional electronic drive package 44 which controls a motor driving drive wheel 32. The current 46 drawn by the drive motor is indicative of the magnitude of frictional resistance between roller 16 and cleaning web 26 and is preferably held constant during roller cleaning. Controller 42 outputs through a conventional I/P transformer 48 to adjust the opening of valve 38 to increase or decrease the second force exerted locally on the cleaning pad and thereby to maintain as constant the amperage drawn by the drive motor. An alarm 49 can also be activated by the controller.

The system described thus far is the subject of the allowed parent application. We have found that this system works well for cleaning lightweight, small-diameter process rollers driven by relatively small motors, for example, a roller having a diameter of 4 inches, a length of 60 inches, and a weight of 50 pounds, being driven by a ¼ horsepower motor. Small absolute changes in motor load associated with increased friction at the cleaning point can represent large percentage changes and can be readily sensed and controlled.

However, for much larger rollers, this patented system can be sub-optimal, for example, a roller having a diameter of 12 inches, a length of 200 inches, and a weight of 1200 pounds, being driven by a 3 horsepower motor. Small absolute changes in motor load can represent only small percentage changes which may not be readily detectible. In addition, because of much higher inertial force associated with a massive rotating roller, roller damage from cleaning pad friction may begin at an even lower signal level than with a smaller roller.

We have found the following novel control system, which does not depend on sensing motor load, to be suitable for use with rollers of any size and weight. Instead of sensing parametric changes on the roller side of the frictional pair, this system senses changes on the cleaning apparatus side, specifically the torque imposed on the cleaning assembly by contact with the rotating roller.

Referring to FIG. 2, a roller cleaning system 50 in accordance with the invention includes a roller cleaning assembly 52 and controller in a control loop 54. Assembly 52 includes a first frame 56 disposed for translation along rail guide 20 parallel to the axis of process roller 16 and at a predetermined, preferably variable, distance therefrom. A pivotable frame assembly 55 includes a second frame 58 pivotably mounted on first frame 56 via matching bores in both frames and a pivot pin 60 therein. The axis of the bores and pin is substantially parallel to the axis of roller 16, permitting second frame 58 to swing through an arc orthogonal to the axis of roller 16. Pivotable frame assembly 55 also includes a third frame 62 adjustably mounted on second frame 58 via an alignment channel 64 and upper and lower adjustment screws 66 and 68, respectively. Third frame 62 supports a feed roll 28, a take-up roll 30 for a cloth cleaning web 26, a cleaning pad backing element 24 for urging web 26 against the surface of roller 16 at a first force, and an actuator 34. Screws 66,68 may provide static pressure adjustment, but the pressure may be varied dynamically by one or more controllable actuators, such as pneumatic actuators whereby the first force over the entire surface of the cleaning pad may be varied by varying the supply of pressurized air thereto, preferably by a programmable controller.

As in the parent application, actuator 34 is disposed against a central portion of the backing element 24 to create a locally higher and variable second force thereupon. The magnitude of the first force may be varied by adjustment of the adjustment screws 66,68 to move third frame 62 closer to or farther from process roller 16. Preferably, backing element 24 includes a resilient mesh layer 27 on its back side and comprises a sponge cartridge which may be readily replaced in the cleaning assembly.

The actuators 34, 66 & 68 may be hydraulic, pneumatic, electromechanical or electromagnetic devices.

First frame 56 includes an extension 70 opposite a lower portion 72 of second frame 58. In the space therebetween is mounted a strain gauge 74 having a base 76 supported by extension 70 and a load button 78 in contact with second frame 58. Strain gauge 74 is thus positioned to detect torque, and changes in torque, of second and third frames 58,62 about pivot pin 60 relative to first frame 56. A suitable strain gauge, for example, is an OMEGADYNE Model LCGD-100 load cell, available from Omegadyne, Inc., Sunbury, Ohio USA.

A first reservoir 80 holds a supply of cleaning fluid 82, and a second reservoir 84 holds a supply of cleaning additive 86, for example, a detergent, which may be supplied individually or together via tubing 88 to cleaning pad 24. The cleaning fluid may be supplied to the pad itself or directly into the nip between the cleaning web 26 and roller 16.

The control loop 54 controller 42, preferably a programmable controller, taking its input signal from strain gauge 74, and an alarm 49, I/P transformer 48, and reducing valve 38 as described hereinabove. The controller may include an A/D converter which provides a digital representation of the input signal and an electronic computer (microprocessor based system).

In operation, roller 16 is rotated at a fixed speed in either the A or B direction. A flow of cleaning fluid 82 is established to backing element 25 and cleaning web 26. Third frame 62 is advanced toward roller 16 to urge the cleaning pad against the roller at a desired first cleaning force. Actuator 34 is engaged by compressed air against a portion of the back side of backing element 25 creating a desired magnitude of second force thereupon. The air pressure supplied to the actuator is the controller output variable. The signal from strain gauge 74 is the controller set point. Under operating conditions, the controller will vary the air output to the actuator to maintain a constant signal from the strain gauge, thereby preventing build-up of frictional drag and avoiding potential damage to the surface of the roller during cleaning. If frictional resistance continues to tend to increase, the controller will continue to reduce air output to the actuator until the limit of control is reached, at which time the controller may activate an alarm or may terminate further cleaning in known or obvious fashion, or both.

The force on the strain gauge is an arithmetic combination of the gravitational force on the second and third frames and the frictional drag between the cleaning pad and the roller. If the roller is rotating in direction B, toward the strain gauge, increasing drag causes an increasing signal from the strain gauge. If rotation is in direction A, away from the strain gauge, increasing drag causes a decreasing signal. The controller must be provided with the proper response algorithm.

Other means of measuring torque on second and third frames 58,62 about pivot pin 60 may be selected and are within the scope of the invention. For example, a rotary strain gauge may be substituted for pivot pin 60, wherein the strain gauge is fixed to both first frame 56 and second frame 58 and torque is sensed in the pivot pin itself.

The controller of the subject invention may also be programmable to respond to a variable set point which biases the strain gauge output, so that the first and/or second forces may be varied with time. Since the cleaning apparatus may be mounted to traverse axially along the roller during a cleaning cycle, this feature permits differing portions of the roller to be cleaned at differing amounts of force on the cleaning pad without triggering an out-of-control response by the controller. Thus, for example, the outer portions of the roller surface near the ends, which typically bear a preponderance of the particulate contamination on a contact cleaning roller, may benefit from increased first and/or second cleaning forces. Additionally, vigorous cleaning of the roller surface may not be needed on every axial cycle of the traversing cleaning system along the length of the roller, and pad life may be extended by programming the controller to exert a higher first and/or second force on, for example, every fifth or tenth such cycle.

From the foregoing description it will be apparent that there has been provided an improved method and apparatus for cleaning a roller, wherein a pivotable cleaning assembly includes a strain gauge responsive to the frictional resistance of a cleaning pad against the roller and a controller responsive to the strain gauge to vary the force directed against a portion of the back side of the cleaning pad and thereby to maintain a constant frictional resistance. Variations and modifications of the herein described roller cleaning method and apparatus, in accordance with the invention, will undoubtedly suggest themselves to those skilled in this art. Accordingly, the foregoing description should be taken as illustrative and not in a limiting sense.

What is claimed is:

1. A system for cleaning contamination from the surface of a rotating roller, comprising:

a) a first frame spaced from the roller to be cleaned;

b) a frame assembly pivotably attached to said first frame for rotation about a pivot axis substantially parallel to the longitudinal axis of the roller to be cleaned and disposed between said first frame and said roller;

c) a cleaning pad mounted on said frame assembly and disposable into contact with said roller;

d) means mounted on said frame assembly and actuable in the direction of said roller for urging said cleaning pad against said roller;

e) means for sensing torque imposed on said frame assembly relative to said first frame about said pivot axis; and f) a controller responsive to said sensed torque to vary said urging to maintain said torque at a predetermined level.

2. A system in accordance with claim 1 wherein said means for urging comprises:

a) adjustable means for urging said cleaning pad against said roller at a first force; and b) an actuator disposed against a portion of said cleaning pad and actuable in the direction of said roller for urging said portion of said cleaning pad against said roller at a second force.

3. A system in accordance with claim 1 further comprising means for causing said first frame and said frame assembly to be axially displaceable along a path parallel to said longitudinal axis of said roller to be cleaned.

4. A system in accordance with claim 3 wherein said predetermined torque level may be varied dynamically during said axial displacement of said frames.

5. A system in accordance with claim 2 wherein said control loop can vary said second force provided by said actuator.

6. A system in accordance with claim 2 wherein said actuator is selected from the group consisting of a hydraulic cylinder, and an electromechanical and electromagnetic device.

7. A system in accordance with claim 1 wherein said frame assembly includes a second frame pivotable about said first frame and a third frame slidable on said second frame.

8. A system in accordance with claim 7 wherein said means for sensing is disposed between said first frame and said second frame.

9. A system in accordance with claim 1 wherein said means for sensing includes a strain gauge.

10. A system in accordance with claim 1 wherein said cleaning pad includes a backing element and a cleaning web.

11. A system in accordance with claim 1 wherein said controller is programmable to keep said torque output signal at a substantially constant value during cleaning of said roller and to terminate said cleaning when the control limit of said control loop is exceeded.

12. A system in accordance with claim 1 wherein said controller is programmable to activate an alarm when an out-of-standard condition exists.

13. A system in accordance with claim 1 further comprising means for providing cleaning fluid to said cleaning pad.

14. A method for cleaning contamination from the surface of a rotating roller, comprising the steps of:

a) providing a cleaning pad in rubbing contact with the surface of the roller to be cleaned, said pad being urged against said roller at an urging force;

b) determining the torque exerted by frictional drag on said pad about an axis parallel to the longitudinal axis of said roller; and c) controllably varying the magnitude of said urging force to maintain said torque at a constant value.

15. A method in accordance with claim 14 wherein said urging force comprises a first force from the entire rubbing surface of said pad being urged against said roller and a second force from a portion of said rubbing surface being urged against said roller.

16. A method in accordance with claim 15 wherein said first force is fixed and said second force is controllably varied.

17. A method in accordance with claim 15 further comprising the step of translating said cleaning pad axially of said roller while performing steps a, b, and c.

* * * * *